US012716668B1

(12) United States Patent
Herring

(10) Patent No.: US 12,716,668 B1
(45) Date of Patent: Aug. 25, 2026

(54) FIREARM RECEIVER SYSTEMS OFFERING A FIXED BARREL ARRANGEMENT AND PRESSURE RELIEF CAPABILITY

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 61 days.

(21) Appl. No.: 19/293,504

(22) Filed: Aug. 7, 2025

(51) Int. Cl.

| | |
|---|---|
| ***F41A 3/66*** | (2006.01) |
| ***F41A 3/72*** | (2006.01) |
| ***F41A 9/34*** | (2006.01) |
| ***F41C 23/16*** | (2006.01) |

(52) U.S. Cl.
CPC *F41A 3/66* (2013.01); *F41A 3/72* (2013.01); *F41A 9/34* (2013.01); *F41C 23/16* (2013.01)

(58) Field of Classification Search
CPC ..... F41C 23/16; F41C 7/00; F41A 3/66
See application file for complete search history.

(56) References Cited

U.S. PATENT DOCUMENTS

| | | | | |
|---|---|---|---|---|
| 1,293,021 | A | 2/1919 | Browning | |
| 1,628,226 | A | 5/1927 | Browning | |
| 2,845,001 | A | 7/1958 | Hillberg | |
| 4,942,802 | A | 7/1990 | Stoner | |
| 6,634,274 | B1 | 10/2003 | Herring | |
| 8,769,853 | B1 * | 7/2014 | LaRue | F41C 23/16 42/71.01 |
| 10,746,493 | B1 | 8/2020 | Steimke et al. | |

(Continued)

FOREIGN PATENT DOCUMENTS

| | | |
|---|---|---|
| EP | 3477239 | 1/2019 |
| WO | 2021045851 | 3/2021 |

OTHER PUBLICATIONS

M37: The Ultimate Improved Browning 1919; https://surplused.com/index.php/2019/03/08/m37-the-ultimate-improved-browning-1919; Mar. 8, 2019; www.surplused.com; [Retrieved Jun. 27, 2025].

(Continued)

*Primary Examiner* — J. Woodrow Eldred
(74) *Attorney, Agent, or Firm* — David O. Simmons; IVC Patent Agency

(57) ABSTRACT

A firearm receiver system comprises a receiver and a handguard. The receiver includes a front mounting body and a central bore configured for having a bolt carrier slidably disposed therein. The central bore includes a barrel-receiving receptacle at least partially located within the front mounting body. The handguard includes a handguard mounting body receptacle at a first end portion thereof. The front mounting body includes a plurality of interior surfaces each matingly engaged with a corresponding one of a plurality of exterior surfaces of the handguard mounting body receptacle. The receiver and the handguard may unitarily-formed body. The receiver may be configured for accommodating a barrel extension. The front mounting body may be configured for providing a fixed-barrel receiver system. The receiver may accommodate a pressure relief body for enabling the receiver to exhibit pressure relief functionality in the event of an over-pressure event within the receiver.

21 Claims, 11 Drawing Sheets

(56) References Cited

U.S. PATENT DOCUMENTS

| | | | |
|---|---|---|---|
| 11,268,774 | B1 | 3/2022 | Landies et al. |
| 11,598,600 | B2 | 3/2023 | Landies et al. |
| 11,879,702 | B2 | 1/2024 | Franssen et al. |
| 12,092,414 | B2 | 9/2024 | Steimke et al. |
| 2019/0331450 | A1 | 10/2019 | Steimke et al. |

OTHER PUBLICATIONS

MG34 reversible feeds; https://www.k98kforum.com/threads/mg34-reversible-feeds.3046/; Sep. 11, 2011; www.k98kforum.com; [Retrieved Jun. 27, 2025].

The HK21E, HKs best Beltfed; https://www.youtube.com/watch?v=no63zaxmBGE; Sep. 25, 2021; www.youtube.com; [Retrieved Jun. 27, 2025].

M240C; https://www.usord.com/weapons/m240c; 2025; www.usord.com; [Retrieved Jun. 27, 2025].

Ohio Ordnance Works REAPR MG—The "Grim Reaper" from the USA prefers the .338 Norma Magnum caliber. Why ?; https://www.all4shooters.com/en/shooting/pro-zone/ohio-ordnance-works-reapr-mg-in-norma-magnum/; Feb. 28, 2024; www.all4shooters.com; [Retrieved Jun. 27, 2025].

KAC is Refreshing Its MG; https://wmasg.com/en/articles/view/9639 Oct. 15, 2019; www.mwasg.com; [Retrieved May 2, 2025].

* cited by examiner

FIREARM RECEIVER SYSTEMS OFFERING A FIXED BARREL ARRANGEMENT AND PRESSURE RELIEF CAPABILITY

FIELD OF THE DISCLOSURE

The disclosures herein relate generally to firearms, and more particularly to firearm receiver systems offering automatic and/or semi-automatic firing capability, a fixed barrel arrangement, pressure relief capability, and belt-feed capability.

BACKGROUND

Many firearms, such as assault rifles, that are commonly used in military situations are not designed by their manufacturer for use with belt-feed ammunition. Typically, such firearms are designed by their manufacturers for receiving ammunition from an ammunition magazine. The AR15 family of firearms, including the M16 and M4 type firearms, illustrate examples of assault rifles and carbines that are designed by their manufacturer to receive ammunition exclusively from an ammunition magazine. M16 and M4 type firearms are a military version of the AR15 family of firearms capable of operating in a fully automatic or select-fire mode. M16 and M4 type firearms have been manufactured by companies including, but not limited to Colt Defense, FN Manufacturing, LMT Defense, Heckler & Koch and others. AR-15 style rifles, which are operable only in semi-automatic mode, are commercially-available from numerous manufacturers in civilian markets.

The bolt carrier group of many automatic firearms, such as AR15, M16 and M4 type firearms, are energized using gas pressure produced by the combustion of powder in a cartridge. Such firearms are considered to be gas energized. In such firearms, it is typical for combustion gas to be routed from the barrel to the receiver assembly that carries the bolt carrier group (referred to herein as the bolt-carrying receiver). In this manner, pressure associated with the combustion gas is used to supply the energy needed for facilitating ejection of a spent cartridge case from the firing chamber and feeding of a new round of ammunition into the firing chamber. Accordingly, the bolt carrier groups of these types of firearms are gas driven as well as gas energized. AR15, M16 and M4 type firearms are generally referred to as being "direct-gas impingement" firearms. The direct-gas method of operation was partly selected by the firearm's designer due to its relative simplicity, light weight, and low part count.

One distinct advantage of a direct-gas impingement system such as that used on AR15, M16 and M4 firearms is the bolt-carrier's centerline thrust, which delivers minimal perturbation of the firearm's barrel and adverse accuracy effects. However, the routing of the combustion gas to the bolt-carrying receiver results in several adverse situations. One adverse situation is that over time, deposits from the combustion gas are formed inside the bolt-carrying receiver. Such deposits adversely affect operation of the firearm and, in some cases, prevent its operation until the bolt-carrying receiver is cleaned. Another adverse situation is that the combustion gases are vented into the general area of an operator's face, impairing the operator's sight and respiration.

Some firearms known in the art (e.g., the FightLite MCR) are gas energized, but combustion gas energy is transferred to the bolt carrier group through a forward mounted gas piston and cylinder arrangement. The combustion gas produced during firing of a round of ammunition generate energy that acts upon a tappet style pusher rod to bias the bolt carrier group into a recoil stroke. Such a gas piston firearm energizing arrangement vents excess combustion gasses further forward of the bolt-carrying receiver and operator in order to advantageously reduce firearm fouling and enhance the safety and comfort of the operator.

Fixed" barrel firearms (e.g., AR15, M16) are well known in the art to have a barrel characterized as being affixed to an upper receiver body (i.e., a receiver body) and not being user-removeable in the field. Other firearms (e.g., MCR, M60, M249, Mk-48, Negev, PKM) are known in the art to have a user-removeable barrel characterized as being able to be removed by a user in the field without tools (i.e., "quick-change"), thereby offering mission flexibility and heat mitigation in the field. Fixed-barrel firearms are generally considered to offer greater accuracy than quick-change barrel firearms, as the interfacing tolerances of a fixed barrel firearm are generally tighter than that of quick-change barrel firearms. By contrast, quick-change barrels have looser interface tolerances to permit effective barrel exchange without tools, which may degrade accuracy as compared to fixed-barrel counterparts.

In many situations, such as in military combat, a high capacity ammunition delivery system such as a belt-feed system is preferred over an ammunition magazine. A typical ammunition belt for a belt-feed system holds 100 or more rounds of ammunition. At a firing rate of 750 rounds per minute, a 200 round ammunition belt can be depleted in as little as about 8 seconds. Accordingly, for a given firearm design, the minimum time to depletion of a 100 round ammunition belt is as much as about 3.5 times greater than that of a 30-round ammunition magazine. As a result of the increased time to depletion, belt-feed ammunition systems are preferred, at least as an option in addition to magazine-fed ammunition, in many military situations.

Modern rifles, particularly those utilized by law enforcement and military personnel, are designed to operate at relatively high chamber pressures. For example, AR-15 style rifles are designed to operate at a maximum chamber pressure of about 50,000 psi. When an operating event arises where the chamber pressure exceeds the designed maximum chamber pressure, an over-pressure event may occur during which the front end portion of the receiver of the firearm may explode or otherwise suffer pressure-induced damage (up to and including component fragmentation). Examples of causes of an over-pressure event include, but are not limited to, firing a round of ammunition having an improper specification of projectile, firing a round of ammunition having a damaged projectile, firing a round of ammunition having a damaged casing, firing a round of ammunition having an improper specification of propellant, and the like. Such explosion or pressure-induced damage is highly dangerous to the shooter of the firearm and generally renders the firearm unrepairable.

Accordingly, firearm receiver systems that offer features such as automatic and/or semi-automatic operability in combination with one or more of a fixed barrel mounting arrangement, built-in pressure relief capability, and belt-feed capability are advantageous, desirable and useful.

SUMMARY OF THE DISCLOSURE

Embodiments of the disclosures made herein are directed to firearms having structural and operational attributes contributing to a firearm that offers an overall design scheme that shares a high part commonality and manual of arms with current infantry rifles and carbines. These attributes include, but may not be limited to, automatic and/or semi-automatic operability, a fixed barrel, a gas piston firearm energizing arrangement, built-in over-pressure relief capability, and belt-feed capability. The belt-feed capability may be either exclusively or in combination with magazine feed capability. These attributes result in a firearm configuration that is capable of reducing the shortcomings associated with conventional gas-driven automatic firearms with user-removeable barrels that are manufacturer-configured for receiving ammunition exclusively from an ammunition magazine, and that are heavier and less accurate than belt-fed automatic light machine guns and squad automatic weapons that are manufacturer-configured with a belt-feed mechanism. Additionally, built-in over-pressure relief capability is a beneficial attribute to any firearm operating at chamber pressures capable of causing damage to a receiver of the firearm during an over-pressure event.

In one or more embodiments, a firearm receiver system comprises a receiver and a handguard. The receiver includes a handguard mounting body defining a front end portion of the receiver and a central bore configured for having a bolt carrier slidably disposed therein. The central bore includes a barrel-receiving receptacle at least partially located within the handguard mounting body. The handguard includes a handguard mounting body receptacle at a first end portion thereof. The handguard mounting body receptacle includes a plurality of interior surfaces each matingly engaged with a corresponding one of a plurality of exterior surfaces of the handguard mounting body.

In one or more embodiments, a firearm receiver system comprises a main body including a plurality of unitarily-formed functional portions. The unitarily-formed functional portions include a handguard portion, a receiver portion, and a barrel extension retaining portion. The receiver portion includes a central bore configured to receive a bolt carrier slidably disposed therein. The central bore includes a barrel-receiving receptacle at the front end portion of the receiver portion. The barrel extension retaining portion intersects with the barrel-receiving receptacle.

In one or more embodiments, a firearm receiver system comprises a receiver including a central bore configured for having a bolt carrier slidably disposed therein. The central bore includes a barrel-receiving receptacle at a front end portion of the receiver. The receiver includes a magazine-fed ammunition passage below the central bore and a belt-fed ammunition passage above the central bore. The receiver includes an energy delivery member passage located at a position vertically between the magazine-fed ammunition passage and the belt-fed ammunition passage and laterally spaced away from the central bore.

In one or more embodiments, a firearm receiver system comprises a receiver and a fastener. The receiver includes a central bore configured for having a bolt carrier slidably disposed therein. The central bore includes a barrel-receiving receptacle at a front end portion of the receiver. The fastener has a first portion selectively engageable and disengageable with the receiver and a second portion extending from the first portion of the fastener into the barrel-receiving receptacle for enabling engagement with a mating retention portion of a barrel or a barrel extension.

In one or more embodiments, a firearm receiver system comprises a receiver and a pressure relief body attached to the receiver. The receiver includes a central bore configured for having a bolt carrier slidably disposed therein. The central bore includes a barrel-receiving receptacle at a front end portion of the receiver. A pressure relief passage extends between an exterior surface of the receiver and the barrel-receiving receptacle. The pressure relief body is exposed to the pressure relief passage. The pressure relief body inhibits flow of combustion gas produced by discharge of a round of ammunition within the barrel-receiving receptacle through the pressure relief passage when pressure exerted on the pressure relief body by the combustion gas is less than a prescribed relief passage pressure of the pressure relief body. The pressure relief body enables at least a portion of the combustion gas to escape from within the receiver through the pressure relief passage when the combustion gas exerts pressure on the pressure relief body that is at or above the prescribed relief passage pressure.

In one or more embodiments, the handguard mounting body receptacle may include opposing handguard mounting body clamping members.

In one or more embodiments, the firearm receiver system comprises a bolt energizing device where the handguard mounting body and the handguard jointly define a bolt energizing device receptacle for accommodating the bolt energizing device in a fixed orientation relative to the receiver.

In one or more embodiments, one of the interior surfaces of the handguard mounting body receptacle is a bolt energizing device engaging surface thereof; and one of the exterior surfaces of the handguard mounting body is at least partially defined by a bolt energizing device engaging portion of the receiver.

In one or more embodiments, the bolt energizing device may include an operating rod that passes through an operating rod passage (i.e., an energy delivery member passage) of the handguard mounting body, the operating rod passage extends parallel to a centerline longitudinal axis of the central bore, the operating rod passage is located at one of opposing sides of the receiver, and a top side and a bottom side of the receiver are located between the opposing sides.

In one or more embodiments, an energy delivery member may be an operating rod or a gas tube.

In one or more embodiments, an ammunition belt feed assembly is integral with the receiver.

In one or more embodiments, a barrel extension retaining portion of the receiver may include a longitudinal slot extending from an exterior surface of the receiver to the barrel-receiving receptacle to form opposing barrel extension clamping members extending at least partially along a length of the barrel extension retaining portion.

In one or more embodiments, a barrel extension is engaged within the barrel-receiving receptacle, at least a portion of an interior surface of the barrel-receiving receptacle is threaded, and a barrel extension fastener is threadedly engaged with the threaded interior surface of the barrel-receiving receptacle for securing the barrel extension in a fixed position relative to the receiver.

In one or more embodiments, the energy delivery member passage terminates into a space having a bolt carrier energy impingement member channel extending along a first side and a charging handle channel extending along a second side.

In one or more embodiments, the energy delivery member passage extends parallel to a centerline longitudinal axis of the central bore.

In one or more embodiments, the receiver may include a front mounting body (e.g., a handguard mounting body) defining a front end portion of the receiver, the barrel-receiving receptacle is at least partially located within the front mounting body, and the energy delivery member passage is laterally spaced away from the front mounting body.

In one or more embodiments, the energy delivery member passage extends through a front wall of the front mounting body, a barrel extension fastener is threadedly engaged with a threaded exterior surface of the front mounting body for securing the barrel extension in a fixed position relative to the receiver, and the barrel extension fastener may include at least one opening within a front wall thereof and the at least one opening is positioned within the front wall of the barrel extension fastener for enabling alignment of the at least one opening and the inlet of the energy delivery member passage while the barrel extension fastener is threadedly engaged with the front mounting body.

In one or more embodiments, the mating retention portion of the barrel or the barrel extension is a passage and the passage may include a gas relief orifice therein.

In one or more embodiments, the first portion of the fastener (e.g., a pressure relief body) being selectively engageable and dis-engageable with the receiver may include the first portion of the pressure relief body being threadedly engaged with the receiver.

In one or more embodiments, the first and second portions of the fastener are jointly configured for enabling the second portion of the fastener to separate from the first portion of the fastener when combustion gas produced by discharge of a round of ammunition within a barrel attached to the receiver exerts pressure at or above a prescribed relief passage pressure on the second portion of the fastener.

In one or more embodiments, a barrel extension is within the barrel-receiving receptacle, the barrel extension may include the mating retention portion, the second portion of the fastener is engaged with the mating retention portion and the mating retention portion is one of a passage that extends through a peripheral wall of the barrel extension and a recess within the peripheral wall of the barrel extension.

In one or more embodiments, the pressure relief body may include at least one of a wall that bursts when the pressure exerted on the pressure relief body is at or above the prescribed relief passage pressure to enable the combustion gas to escape, a member that moves when the pressure exerted on the pressure relief body is at or above the prescribed relief passage pressure to enable the combustion gas to escape, and a member that detaches when the pressure exerted on the pressure relief body is at or above the prescribed relief passage pressure to enable the combustion gas to escape.

In one or more embodiments, the pressure relief body may include a first portion that is threadedly engaged within a threaded portion of the pressure relief passage.

In one or more embodiments, the pressure relief body may include a gas relief orifice having a cross-sectional area less than a minimum cross-sectional area of the pressure relief passage.

In one or more embodiments, the pressure relief body is a fastener including a first portion threadedly engaged with the receiver and a second portion extending from the first portion of the fastener into the barrel-receiving receptable.

In one or more embodiments, the second portion of the fastener is in spring-biased engagement with the first portion of the fastener for causing the second portion of the fastener to be forcibly biased toward the barrel-receiving receptacle.

In one or more embodiments, the first and second portions of the fastener are jointly configured for enabling the second portion of the fastener to separate from the first portion of the fastener when the combustion gas exerts pressure on the pressure relief body that is at or above the prescribed relief passage pressure.

In one or more embodiments, the pressure relief body being threadedly engaged with the receiver may include the pressure relief body being threadedly engaged within a threaded portion of the pressure relief passage.

These and other objects, embodiments, advantages and/or distinctions of the present invention will become readily apparent upon further review of the following specification, associated drawings and appended claims.

DETAILED DESCRIPTION

Figure 1:
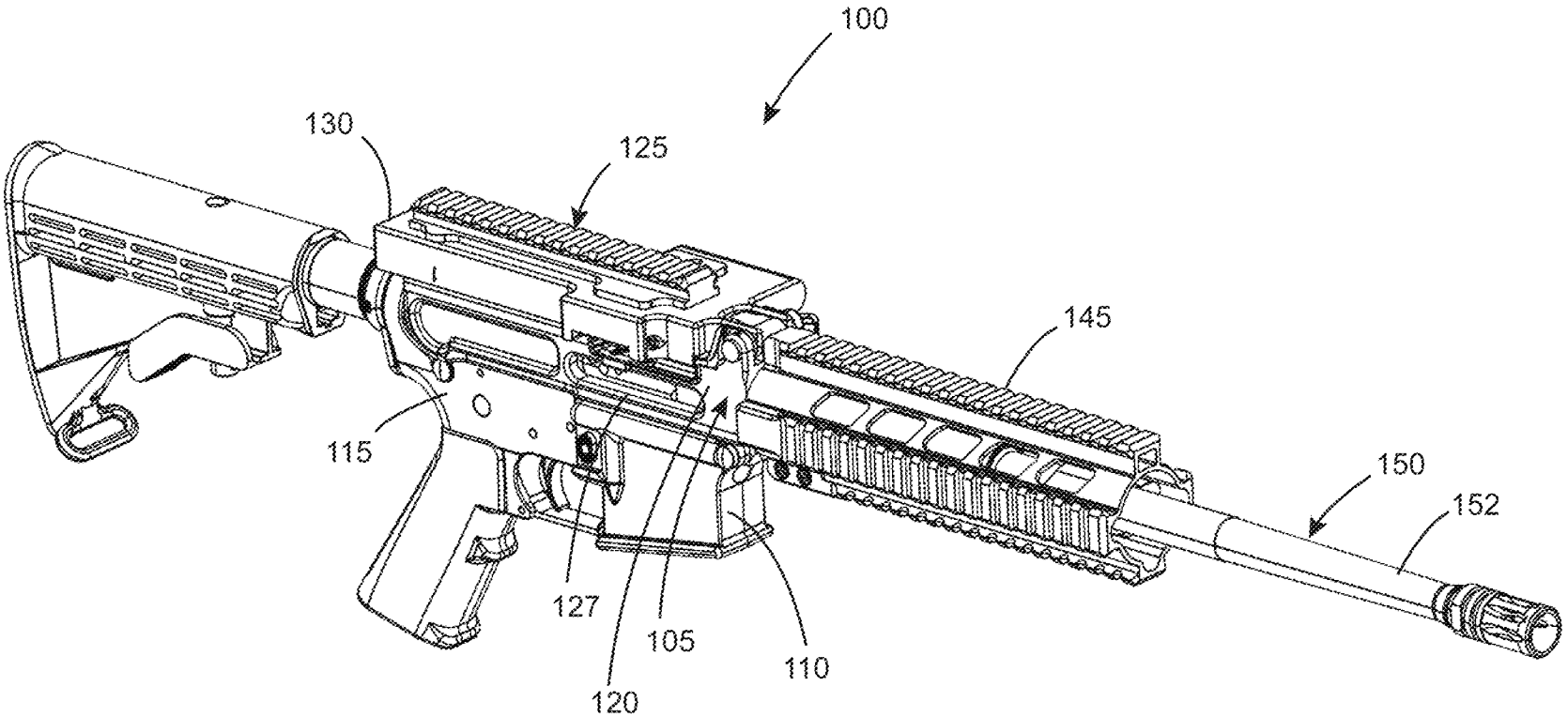
FIG. 1 is a first perspective view of a dual-feed capable firearm having a receiver system in accordance with a first embodiment of the disclosures made herein.
Figure 2:
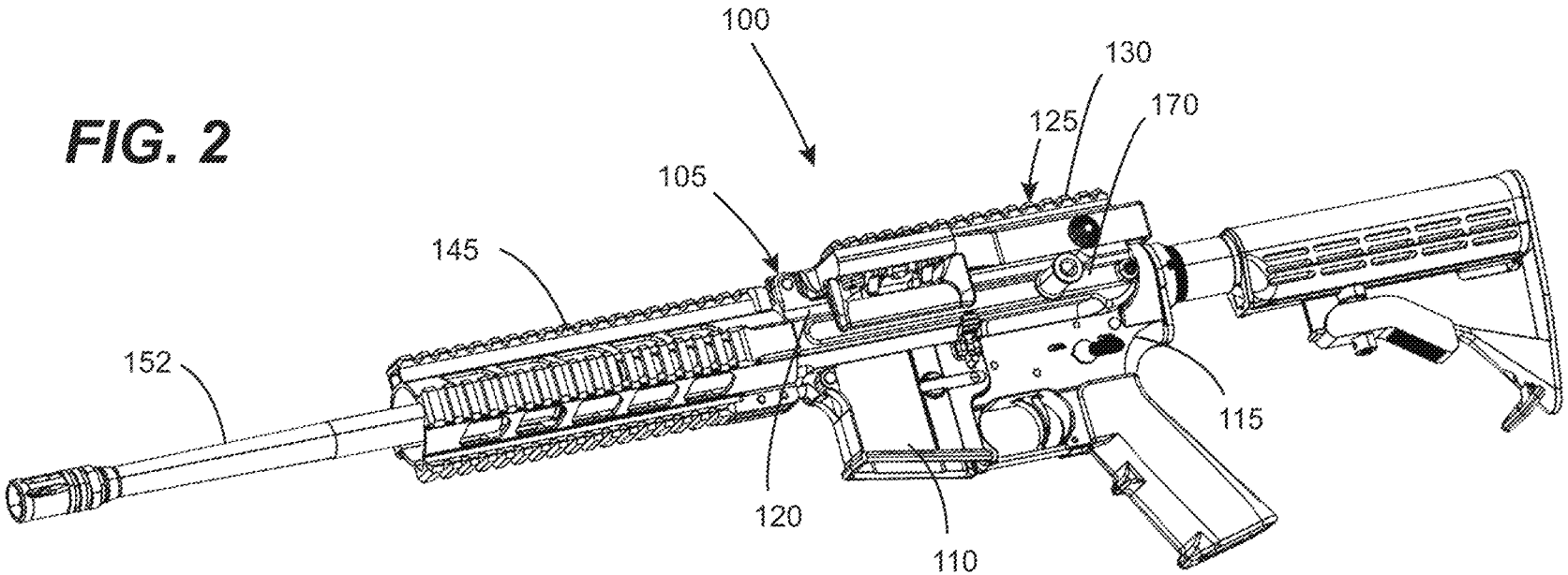
FIG. 2 is a second perspective view of the firearm shown in FIG. 1.

A firearm 100 in accordance with a first embodiment of the disclosures made herein is shown in FIGS. 1-2. A receiver system 105 of the firearm 100 includes a lower receiver body 115 (i.e., a receiver lower body portion) and an upper receiver body 120 (i.e., a receiver upper body portion) attached to the lower receiver body 115. The firearm 100 may have a magazine well 110 for allowing ammunition to be supplied through a bottom (i.e., lower) surface of the upper receiver body 120 via a magazine engaged within the magazine well 110. The firearm 100 may include an ammunition belt feeding apparatus 125 attached to the upper receiver body 120 for allowing ammunition to be supplied through a top (i.e., upper) surface of the upper receiver body 120 via an ammunition belt engaged within the ammunition belt feeding apparatus 125. Regardless of the mode of ammunition supply, spent casings are ejected through an ejection port 127 within a side surface of the upper receiver body 120 between the magazine well 110 and the ammunition belt feeding apparatus 125. The ammunition belt feeding apparatus 125 and upper receiver body 120 jointly define a receiver assembly in accordance with at least some embodiments of the disclosures made herein. Preferably, a handguard 145 of the firearm 100 and a top cover 130 of the ammunition belt feeding apparatus 125 each include accessory mounting structures such as, for example, Picatinny rails for allowing accessories to be selectively mounted on the handguard 145 and the top cover 130.

The lower receiver body 115 and the upper receiver body 120 are an example of a split receiver system. In some embodiments, the lower receiver 115 may be characterized as being a body that includes at least one of a trigger and a magazine well. Receiver systems in accordance with embodiments of the disclosures made herein may have a single receiver. It is disclosed herein that firearms in accordance with embodiments of the disclosures made herein are not limited to having any particular type of configuration of receiver assembly.

The firearm 100 may be configured for being operated in a semi-automatic mode, a fully-automatic mode, or selectively both modes known in the art as select-fire. The firearm 100 may be a rifle, carbine, light machine gun, medium machine gun, heavy machine gun, or the like. For example, the firearm 100 may be in the AR15 family of firearms (i.e., an AR-15 style rifle), including M16 and M4 type firearms. Select-fire and fully-automatic modes of operation are well known in the art. For example, such modes of operation are described in detail in U.S. Pat. No. 6,634,274, which is incorporated herein in its entirety be reference.

Ammunition belt feeding apparatuses in accordance with embodiments of the disclosures made herein are not limited to a particular type or configuration of interface arrangement or mounting bodies for enabling a top cover thereof to be pivotably engaged with a receiver thereof. Examples of ammunition belt feeding apparatuses may be found in U.S. Pat. Nos. 6,634,274 and 3,035,495; European Patent Application No. 0423678A2; and U.S. patent application having Ser. No. 19/197,104, all of which are incorporated herein in their entirety by reference. A person of ordinary skill in the art will be aware of other similar and suitable configurations of ammunition belt feeding apparatuses known in the art.

Referring now to FIGS. 3-8, the upper receiver body 120 includes a central bore 122 (best shown in FIGS. 5-7) configured for having a bolt carrier 124 slidably disposed therein. Operation of bolt carrier groups in a firearm accommodating both magazine-fed ammunition and/or belt-fed ammunition is well known in the art and, as such, operational details of the bolt carrier group will not be discussed herein. The central bore 122 includes a barrel-receiving receptacle 123 (best shown in FIGS. 5 and 6) that extends into a handguard mounting body 129 at a front end portion of the upper receiver body 120. The upper receiver body 120 includes a magazine-fed ammunition passage 117 below the central bore 122 and a belt-fed ammunition passage 119 above the central bore 122.

Still referring to FIGS. 3-8, a barrel assembly 150 of the firearm includes a barrel 152, a barrel extension 154, and a barrel retention ring 156. The barrel extension 154 includes a cylindrical portion with a female-threaded central passage 154A (FIG. 5) that engages a male-threaded chamber end of the barrel 152, as is well known in the art. The cylindrical portion of the barrel extension 154 resides in a close-clearance fit within a mating portion of the barrel-receiving receptacle 123, which is also well known in the art. A flange portion 154C of the barrel extension 154 is seated within a stepped portion of the barrel-receiving receptacle 123A. The barrel retention ring 156 includes a male-threaded external surface that engages a female-threaded mating portion 123A of the barrel-receiving receptacle 123 for securing the barrel extension 154 within the barrel-receiving receptacle 123 in a fixed axial position relative to the centerline longitudinal axis of the central bore 122. Thus, the front end portion of the upper receiver body 120 is a barrel extension retaining portion of the upper receiver body 120.

The barrel retention ring 156 required a specialized tool and removal of the handguard 145 for enabling removal of the barrel 152. Thus, the firearm 100 may be characterized as being a fixed barrel firearm—i.e., the barrel 152 is affixed to the upper receiver body 120 (i.e., a receiver body) in a manner where it is not readily user-removeable in the field without specialized tools and available time for performing such removal. In contrast, other firearms known in the art have a user-removeable barrel characterized as being able to be removed by a user in the field without tools—i.e., having a "quick-change" barrel arrangement.

Rotational orientation of the barrel extension 154 relative to the upper receiver body 120 may be accomplished by a variety of techniques. In one example of such a technique (shown), a protrusion 154B (e.g., a pin) extending from an exterior surface of the barrel extension 154 extends into a mating recess 120E of the upper receiver body 120 within the barrel-receiving receptacle 123 to inhibit unrestricted rotational movement of the barre extension 154 relative to the centerline longitudinal axis of the central bore 122. In another example of such a technique, the flange portion 154C of the barrel extension 154 includes one or more segments (flat perimeter face) that engage a mating flat face of the barrel-receiving receptacle 123 to inhibit unrestricted rotational movement of the barrel extension 154 relative to the centerline longitudinal axis of the central bore 122. Embodiments of a firearm receiver system in accordance with the disclosures made herein is not limited to any particular technique for inhibiting unrestricted rotational movement of the barrel extension 154 relative to the centerline longitudinal axis of the central bore 122.

Referring now to FIGS. 3, 4, 6, and 7, to accommodate both magazine-fed ammunition and/or belt-fed ammunition, the bolt carrier 124 is oriented such that a bolt carrier lug 160 (i.e., a bolt carrier energy impingement member) of the bolt carrier 124 is located between the magazine-fed ammunition passage 117 and the belt-fed ammunition passage 119 and is laterally spaced away from the central bore 122. A bolt energizing device 162 of the firearm 100 is similarly located to the side of the central bore 122 with an operating rod 162A of the bolt energizing device 162 extending through an energy delivery member passage 120D of the receiver 120 into engagement with the bolt carrier lug 160. In some embodiments (shown), a centerline longitudinal axis L1 of the central bore 122 and a centerline longitudinal axis of the energy delivery member passage 120D lay on a horizontally extending reference plane P1 extending through the centerline longitudinal axis of the central bore 122. However, in some embodiments, the energy delivery member passage 120D may be located above or below the horizontally extending reference plane P1.

Figure 7:
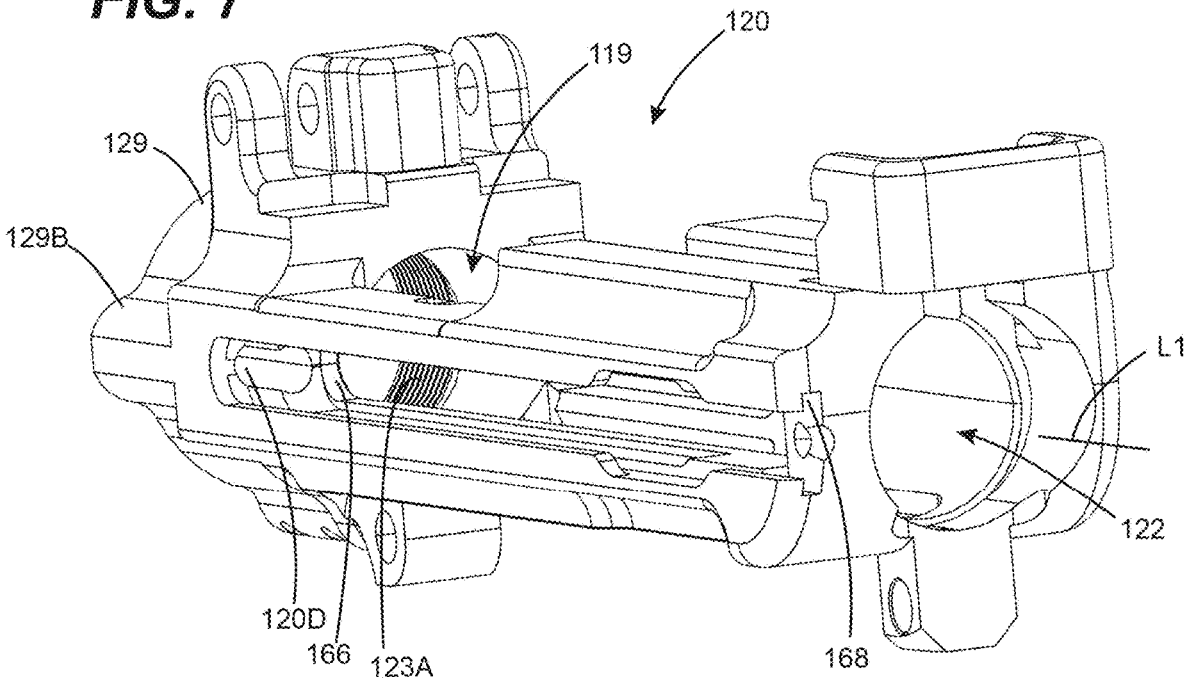
FIG. 7 is a second perspective view of the receiver of the firearm of FIG. 1.
Figure 8:
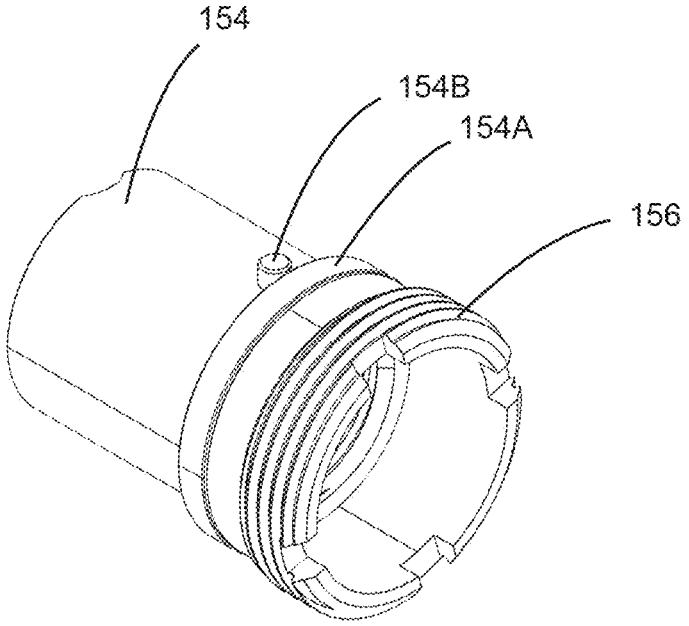
FIG. 8 is a perspective view of a barrel extension and barrel extension retaining ring of the firearm shown in FIG. 1.
Figure 9:
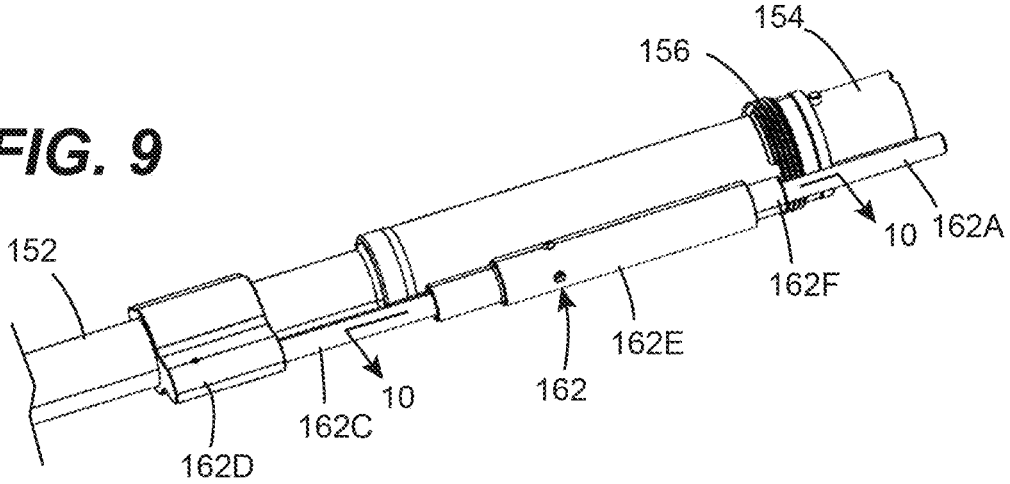
FIG. 9 is a fragmentary view of a bolt energizing portion of the firearm of FIG. 1 in combination with a barrel, barrel extension and barrel retention fastener.
Figure 10:
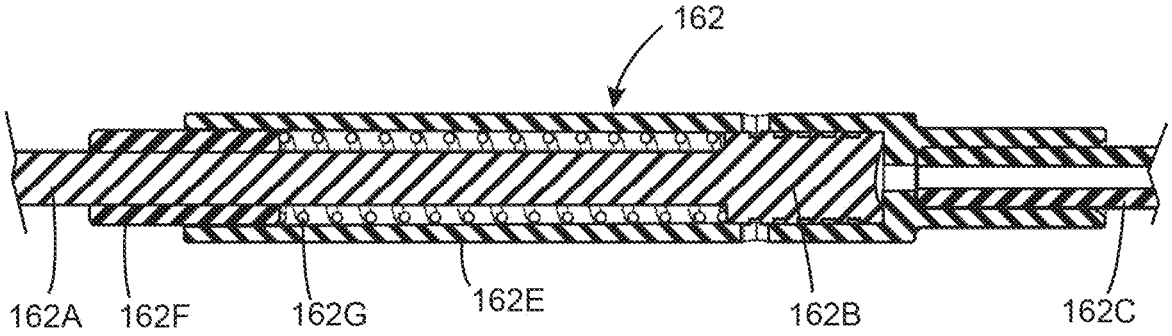
FIG. 10 is a cross-sectional view taken along the line 10-10 in FIG. 9.

In preferred embodiments, the energy delivery member passage 120D may terminate into a space having a bolt carrier lug channel 166 extending along a first side of the space and a charging handle channel 168 extending along a second side of the space, as best shown in FIG. 7. The bolt carrier lug 160 extends through the bolt carrier lug channel 166 for enabling engagement with the operating rod 162A and to constrain the bolt carrier to longitudinal sliding movement along the centerline longitudinal axis L1 of the central bore 122. The energy delivery member passage 120D preferably extends parallel to the centerline longitudinal axis L1 of the central bore 122. A charging handle 170 may be slidably disposed within the charging handle channel 168 and engageable with the bolt carrier lug 160 to enable manual charging movement of the bolt carrier 124, as is known in the art.

As depicted, the bolt energizing device 162 of the firearm 100 is a gas piston type bolt energizing device. The bolt energizing device 162 includes the operating rod 162A, a piston 162B, a gas tube 162C, a gas block 162D, a gas cylinder 162E, an operating rod bushing 162F, and a compression spring 162G. The gas block includes an internal passage that routes combustion gas from within the barrel 152 into the gas tube 162C. The combustion gas pressurizes a space in the gas cylinder 162E between the gas tube and the piston 162B to thereby forcibly move the piston 162B (and attached operating rod 162A) rearward from its at-rest position. The piston 162B is biased forward to its at-rest position by the compression spring 162G, which is constrained between the piston 162B and the operating rod bushing 162F. Forcible movement of the piston 162B rearward causes a corresponding rearward movement of the operating rod 162, thereby exerting force on the bolt carrier lug 160 to thereby drive the bolt carrier 124 in a rearward direction. In this manner, movement of the bolt carrier 124 and attached bolt enable a spent casing to be ejected through the ejection port 127 and correspondingly, the firearm 100 and, as is known in the art, other components of the firearm 100 forcibly urge the bolt carrier 124 forward for enabling an un-fired round of ammunition from either an attached magazine or ammunition belt to be chambered.

Figure 5:
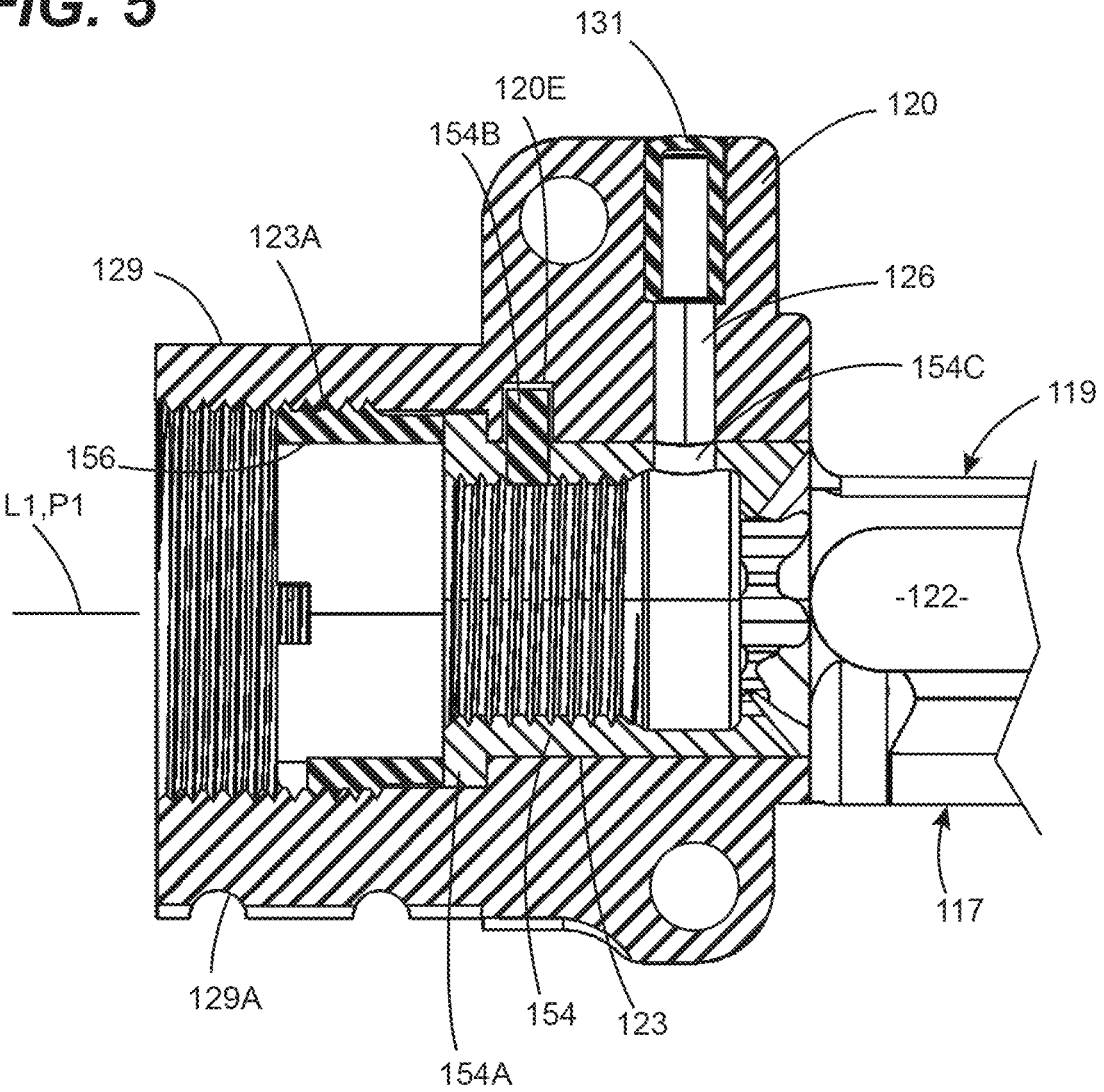
FIG. 5 is a cross-sectional view taken along the line 5-5 in FIG. 3.
Figure 6:
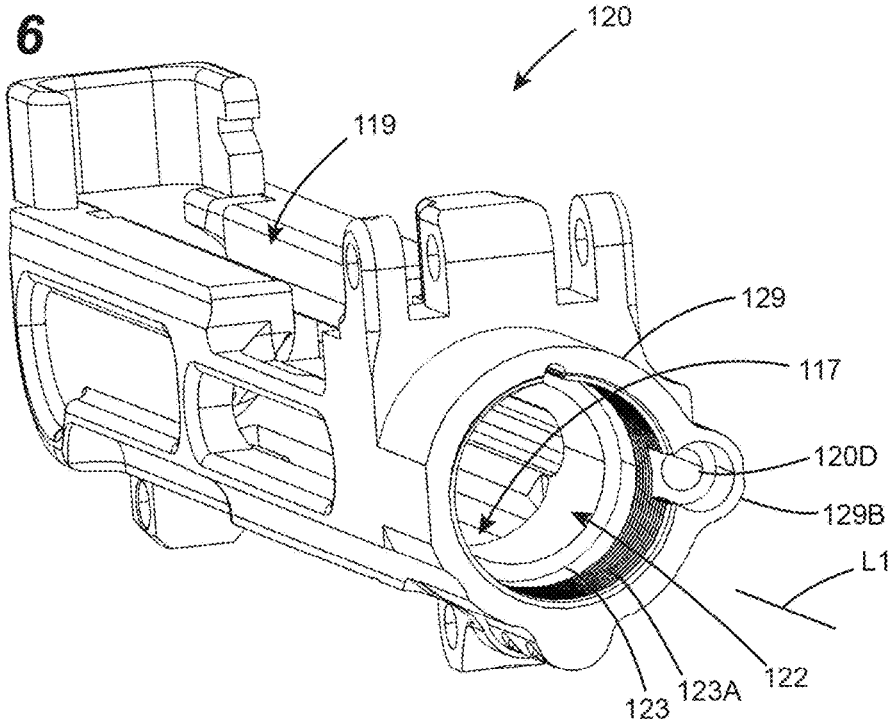
FIG. 6 is a first perspective view of the receiver of the firearm of FIG. 1.

As shown in FIG. 5, a pressure relief passage 126 extends between an exterior surface of the upper receiver body 120 and the barrel-receiving receptacle 123. A pressure relief body 131 is engaged within the pressure relief passage 126 such as via compression fit, bonding, threaded interface, or the like. The pressure relief passage 126 of the upper receiver body 120 intersects a pressure release passage 154C of the barrel extension 154 that extends through its exterior wall. The pressure relief passage 126 of the upper receiver body 120 and the pressure release passage 154C of the barrel extension 154 jointly define a dedicated flow route for combustion gas during escape of combustion gas from the firing chamber during an over-pressure event or other event allowing escape of high pressure combustion gas in to the upper receiver body 120. The pressure relief passage 126 and the pressure relief body 131 jointly enable combustion gases (at least portions of those of the highest pressure) to escape the upper receiver body 120 via a dedicated flow route to facilitate pressure relief functionality in accordance with embodiments of the disclosures made herein. As shown in FIG. 5, such pressure relief functionality includes the pressure relief body 131 is pushed from within the pressure relief passage 126 to enable combustion gases to escape the upper receiver body 120 via the pressure relief passage 126. Advantageously, such pressure relief functionality in accordance with embodiments of the disclosures made herein limits the potential for damage to the firearm and injury to the shooter. This is in contrast to a common scenario where an over-pressure event produced during discharge of a round of ammunition escaping directly into an interior space of the upper receiver body of a firearm and causing undesirable if not catastrophic pressurization within the upper receiver body 120 (e.g., leading to component deformation and fragmentation).

Pressure relief functionality in accordance with embodiments of the disclosures made herein may be facilitated via parameters such as respective cross-sectional area of the pressure relief passage 126 and the pressure relief body 131, calibrated force separation level of the pressure relief body 131 from within the pressure relief passage 126, burst or detachment pressure of one or more portions of the pressure relief body 131 from another, and the like. Examples of structural implementations of pressure relief bodies in accordance with embodiment of the disclosures made herein to facilitate pressure relief functionality may include a wall that bursts when the pressure exerted on the pressure relief body 131 is at or above the prescribed relief passage pressure to enable the combustion gas to escape, a member that moves when the pressure exerted on the pressure relief body 131 is at or above the prescribed relief passage pressure to enable the combustion gas to escape, and a member that detaches when the pressure exerted on the pressure relief body 131 is at or above the prescribed relief passage pressure to enable the combustion gas to escape.

Figure 3:
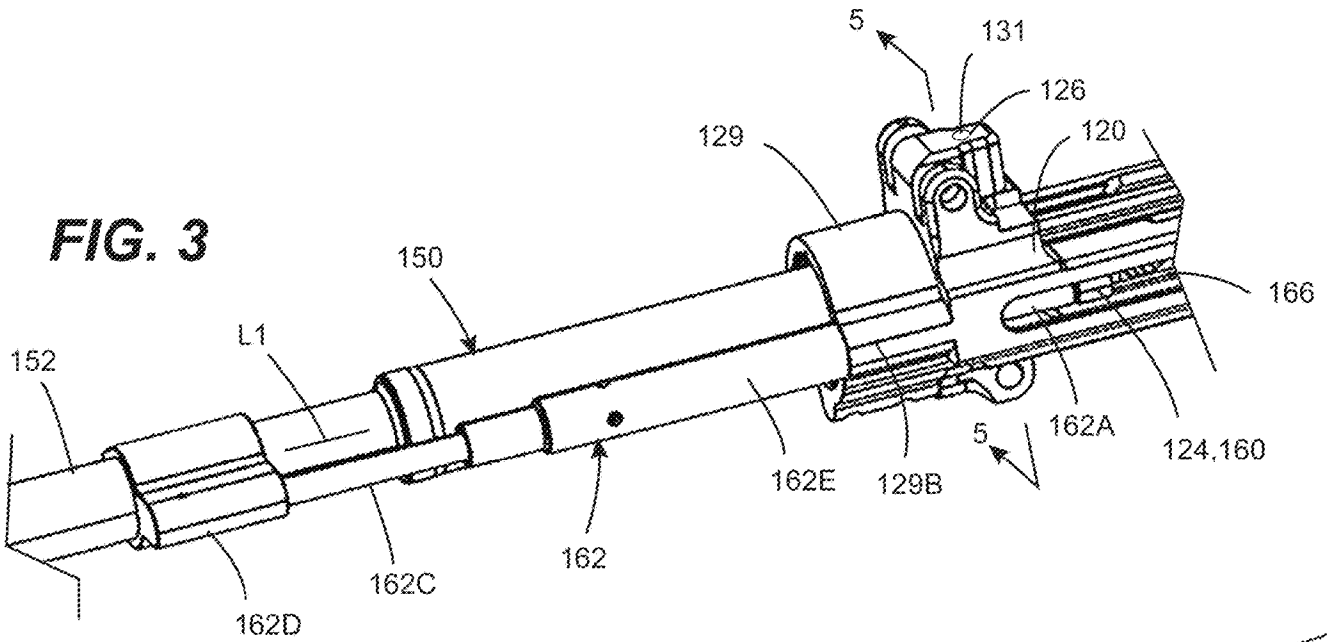
FIG. 3 is a perspective view of the firearm shown in FIG. 1 with handguard, ammunition belt feeding apparatus, trigger group, charging member, and shoulder stock components of the firearm omitted.
Figure 4:
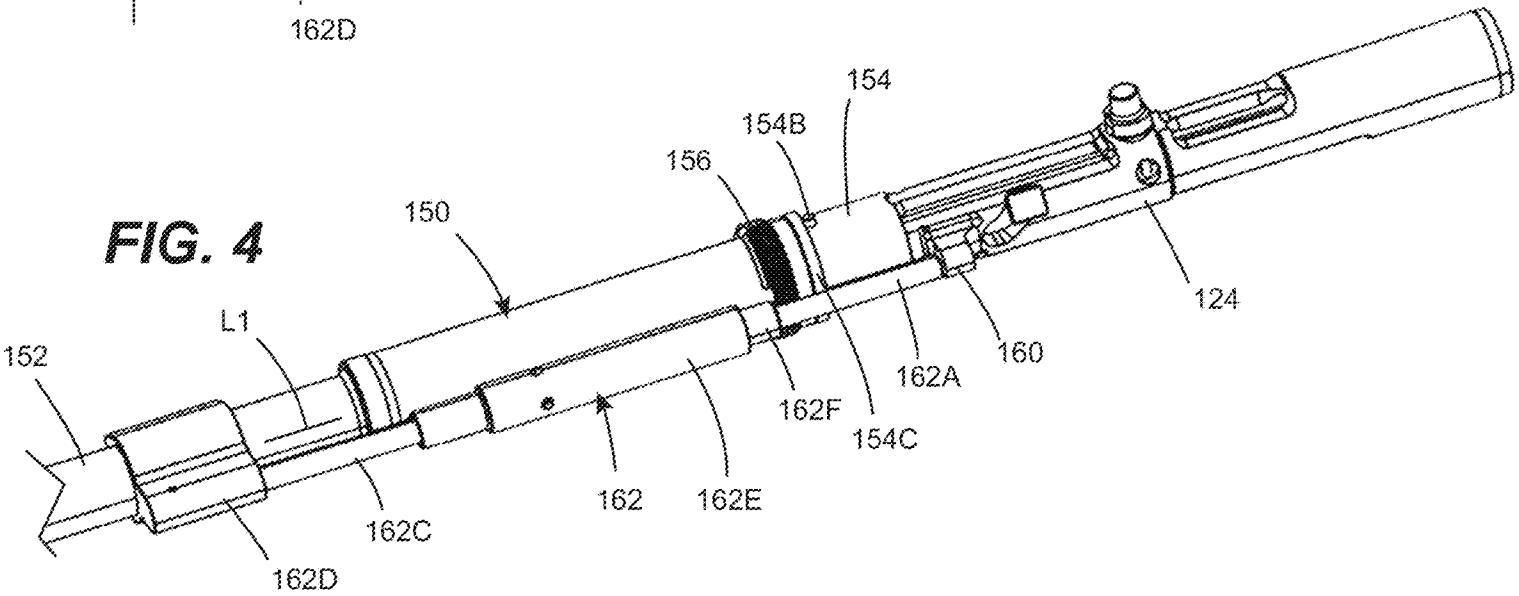
FIG. 4 is a perspective view of the firearm shown in FIG. 1, as shown in FIG. 3 and with the a receiver of the firearm omitted.
Figure 11A:
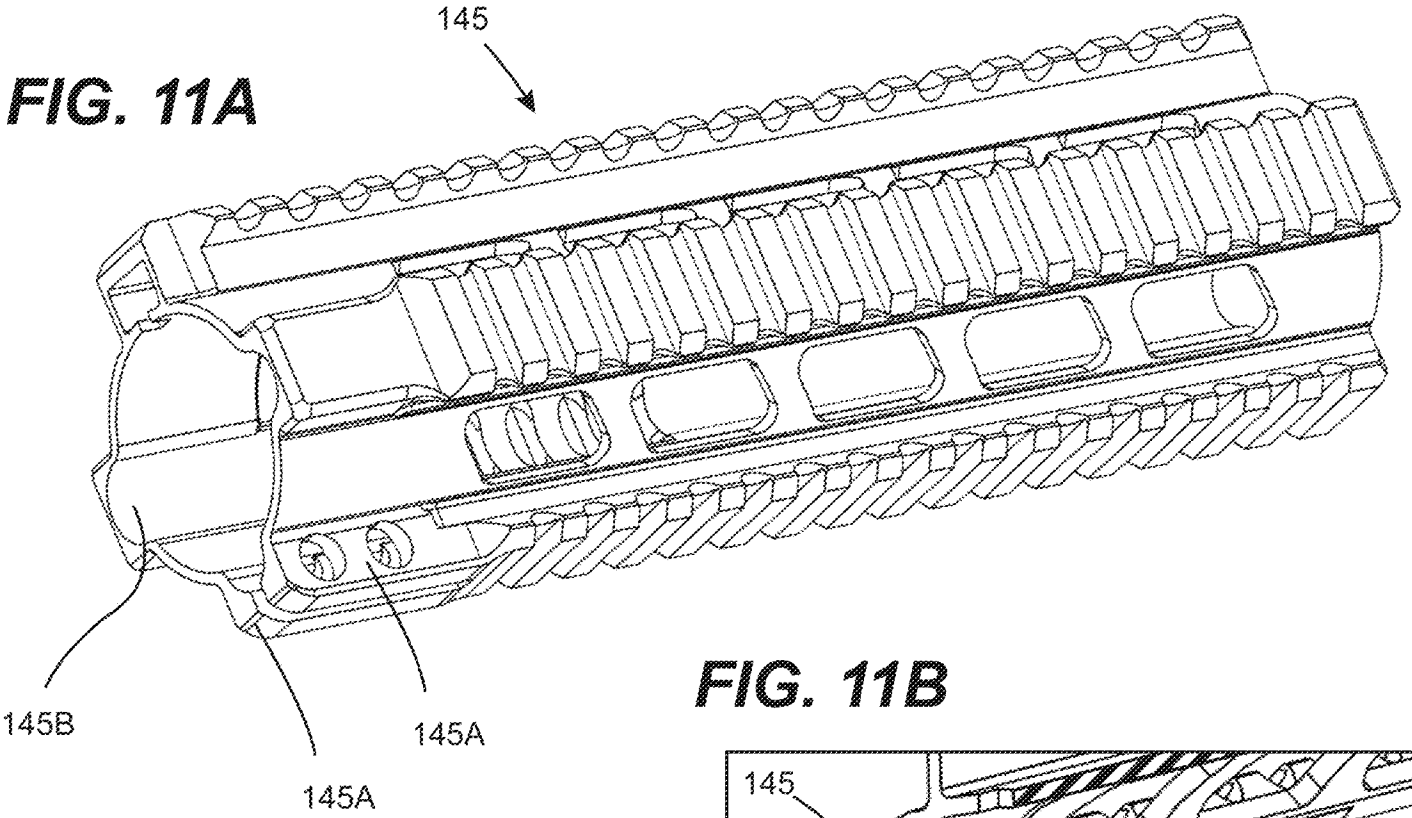
FIG. 11A is a perspective view of the handguard of the firearm of FIG. 1.
Figure 11B:
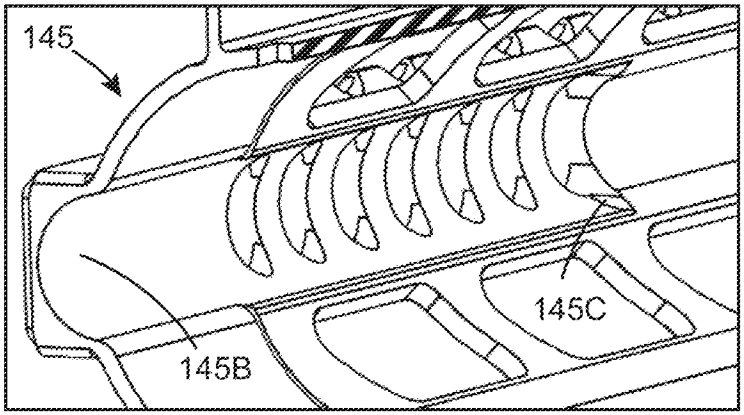
FIG. 11B is a fragmentary cross-sectional view showing a bolt energizing device engagement portion of the handguard in FIG. 11A.

Referring to FIGS. 1, 2, 3, 5, 6, 7, 11A, and 11B, the handguard 145 includes a handguard mounting body receptacle that matingly engages the handguard mounting body 129 of the upper receiver body 120. Opposing clamping bodies 145A and fastener recesses 129A may be provided for enabling the handguard 145 to be fixedly secured to the handguard mounting body 129 via associated fasteners (e.g., threaded fasteners such as bolts). A contoured sidewall 145B of the handguard 145 serves the purposes of engaging a mating contoured portion 129B of the handguard mounting body 129 to fixedly position the handguard 145 rotationally relative to the upper receiver body 120 and to provide space within the handguard 145 for accommodating the bolt energizing device 162. As shown in FIG. 3, a rear portion of the gas cylinder 162E engages a mating portion of the handguard mounting body 129. As shown in FIG. 11B, the handguard 145 may include one or more interior surfaces that define a space for accommodating the gas cylinder 162E. The front portion of the gas cylinder 162E may engage a mating surface 145C of the handguard 145, which partially defines the space for accommodating the gas cylinder 162E, for fixedly orientating the bolt energizing device 162 relative to the handguard 145 and the upper receiver body 120.

Figure 12:
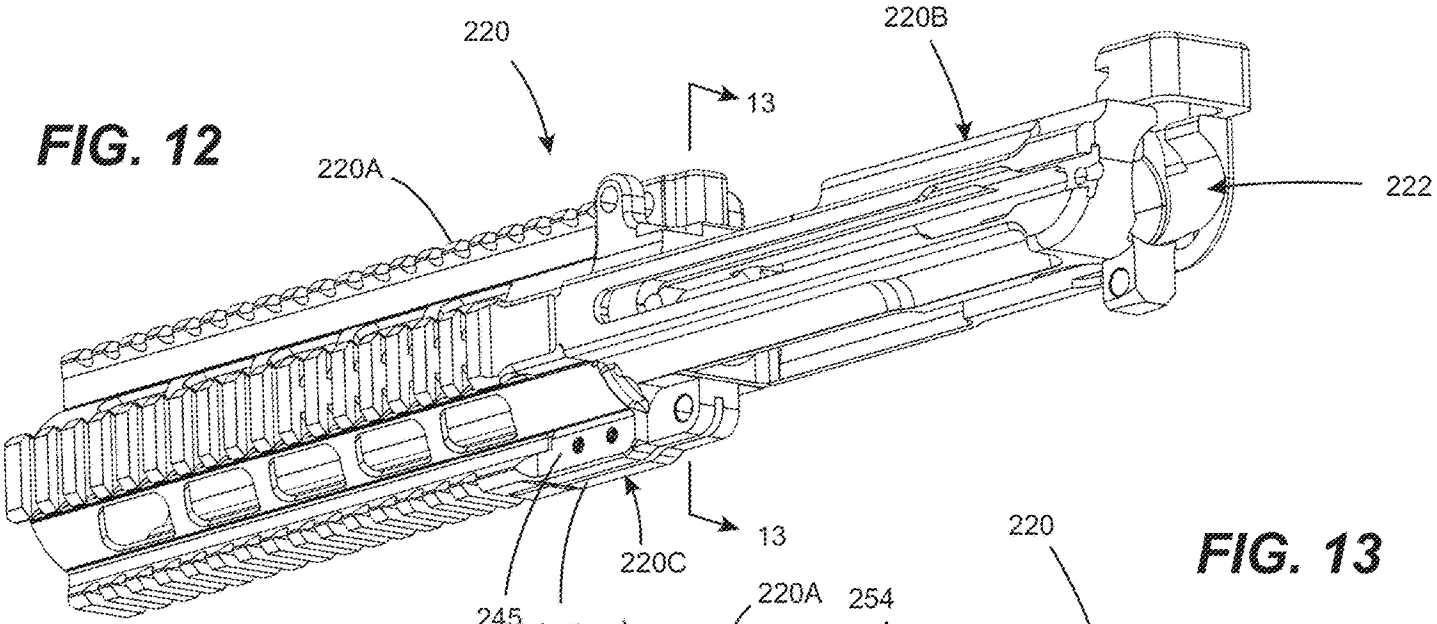
FIG. 12 is a perspective view of a receiver body of a firearm in accordance with a second embodiment of the disclosures made herein.
Figure 13:
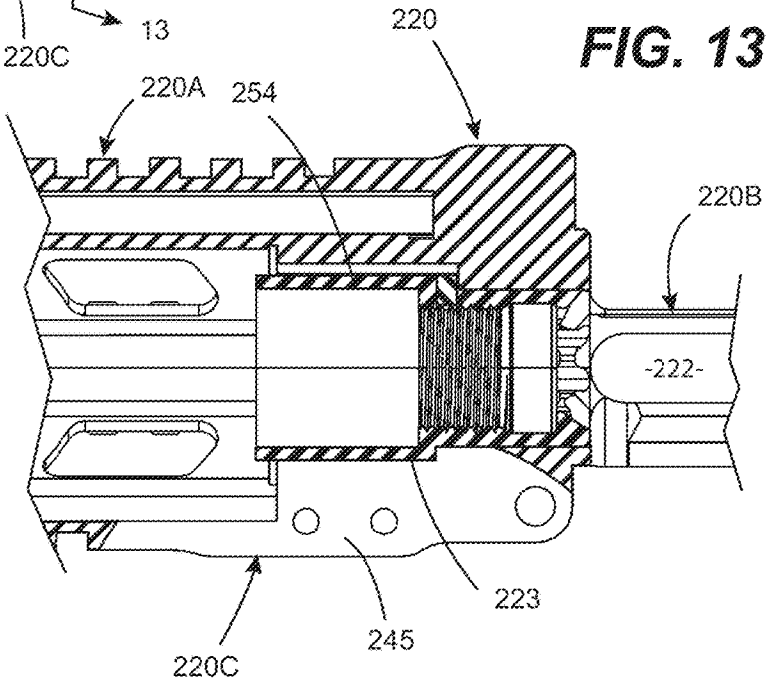
FIG. 13 is a fragmentary cross-sectional view taken along the line 13-13 in FIG. 12.

Referring now to FIGS. 12-13, an upper receiver body 220 of a firearm in accordance with a second embodiment of the disclosures made herein is shown. The upper receiver body 220 is a monolithic main body that includes a plurality of unitarily-formed functional portions. The unitarily-formed functional portions include a handguard portion 220A, a receiver portion 220B, and a barrel extension retaining portion 220C. In this manner, the upper receiver body 220 may be structurally defined as a receiver with a unitarily-formed handguard. The receiver portion 220B may be configured for being supplied with belt-fed ammunition and/or magazine-fed ammunition. The receiver portion 220B includes a central bore 222 configured to receive a bolt carrier (e.g., the bolt carrier 124 discussed above in reference to FIGS. 1-11) slidably disposed therein. The central bore 222 includes a barrel-receiving receptacle 223 at the front end portion of the receiver portion 220B.

The barrel extension retaining portion 220C may include a longitudinal slot extending from an exterior surface of the main body to the barrel-receiving receptacle 223 to form opposing barrel extension clamping members 245 extending at least partially along a length of the barrel-receiving receptacle 223. The opposing barrel extension clamping members 245 may have fasteners engaged therewith for enabling a barrel extension 254 to be fixedly secured within the barrel-receiving receptacle 223 via clamping force exerted on the barrel extension 254 by tightening of the fasteners within mating passages of the opposing barrel extension clamping members 245.

Figure 14:
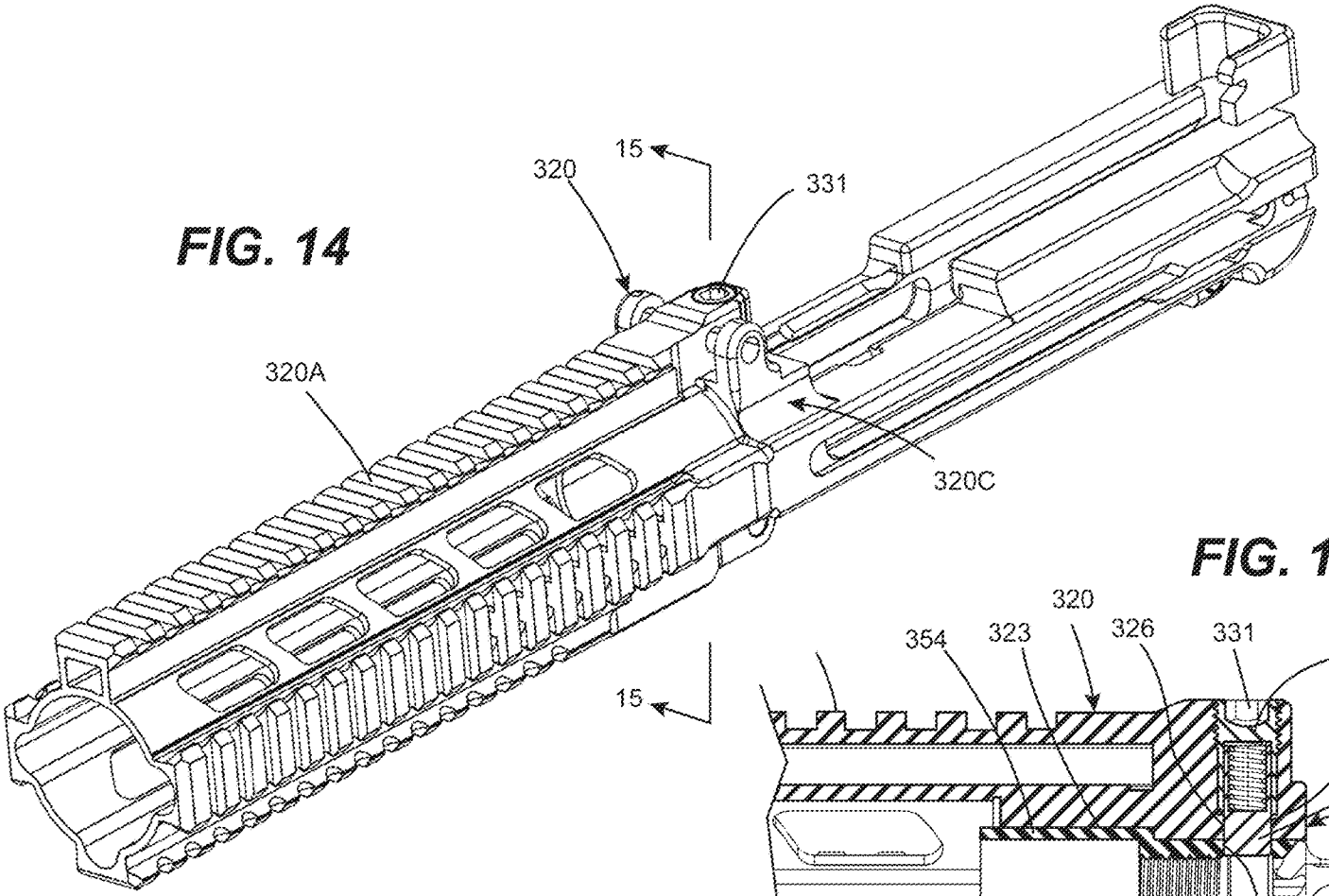
FIG. 14 is a perspective view of a receiver system of a firearm in accordance with a third embodiment of the disclosures made herein.
Figure 15:
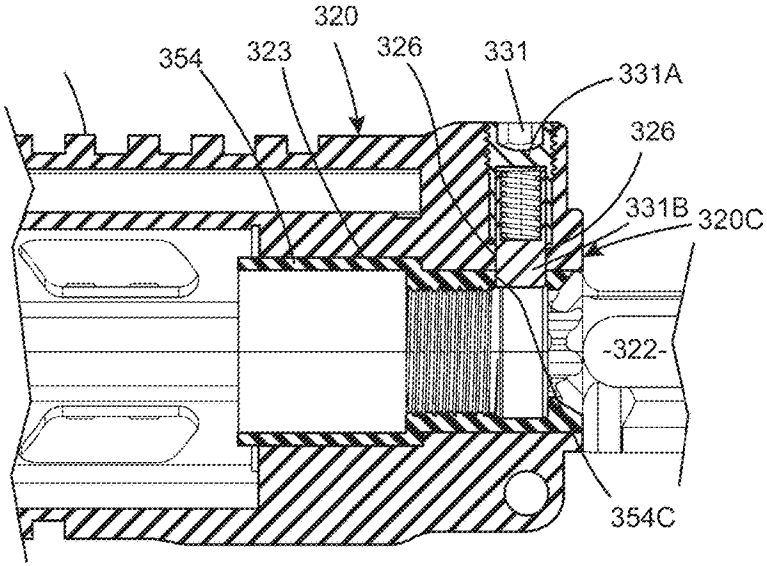
FIG. 15 is a fragmentary cross-sectional view taken along the line 15-15 in FIG. 14.

Referring to FIGS. 14 and 15, an upper receiver body 320 in accordance with a third embodiment of the disclosures made herein is shown. As shown, the upper receiver body 320 may be a monolithic main body in the same manner as discussed above in reference to FIGS. 12-13. However, in some embodiments, a handguard portion 320A of the upper receiver body 320 may be omitted such that the upper receiver body 320 is effectively a receiver with a barrel extension retaining portion and, optionally, a handguard mounting portion at its front end in the same manner as discussed above in references to FIGS. 1-11.

A barrel extension retaining portion 320C includes a pressure relief passage 326 that extends between an exterior surface of the upper receiver body 320 to the barrel-receiving receptacle 323. The barrel-receiving receptacle 323 is configured for receiving a barrel extension 354 therein. A pressure relief body 331 is engaged within the pressure relief passage 326. The pressure relief passage 326 of the upper receiver body 320 intersects a pressure release passage 354C of the barrel extension 354 that extends through its exterior wall. The pressure relief passage 326 of the upper receiver body 320 and the pressure release passage 354C of the barrel extension 354 jointly define a dedicated flow route for combustion gas during escape of combustion gas from the firing chamber during an over-pressure event or other event allowing escape of high pressure combustion gas in to the upper receiver body 320.

The pressure relief body 331 may be a fastener including a first portion 331A threadedly engaged with mating threads within the pressure relief passage 326 and a second portion 331B extending from the first portion 331A of the pressure relief body 331 into engagement with the pressure release passage 354C of the barrel extension 354 within the barrel-receiving receptable 323. To facilitate pressure relief functionality in accordance with embodiments of the disclosures made herein, the threaded engagement between the pressure relief body 331 and the upper receiver body 320 may fail (e.g., become sheared off) during an over-pressurization event for enabling the pressure relief body 331 to be forcibly decoupled from the upper receiver body 320 when the over-pressurization event results in pressure at or above a prescribed relief passage pressure to be exerted on the pressure relief body 331 (e.g., on a face of the second portion 331B of the pressure relief body 331.)

The second portion 331B of the pressure relief body 331 may be in spring-biased engagement with the first portion 331A of the pressure relief body 331 for causing the second portion 331B of the pressure relief body 331 to be forcibly biased into engagement with the pressure release passage 354C of the barrel extension 354. Advantageously, such spring-biasing limits the potential for damage to the barrel extension 354 during over tightening of the pressure relief body 331 into the threaded portion of the of the upper receiver body 320, in order to secure the barrel extension 354 into the barrel-receiving receptacle 323 of the upper receiver body 320, particularly when the pressure release passage 354C of the barrel extension 354 is misaligned with the second portion 331B of the pressure relief body 331, or when the pressure release passage 354C of the barrel extension 354 is dimensioned or is otherwise configured to cause binding during engagement with the second portion 331B of the pressure relief body 331 within the second portion 331B of the pressure relief body 331.

Figure 16:
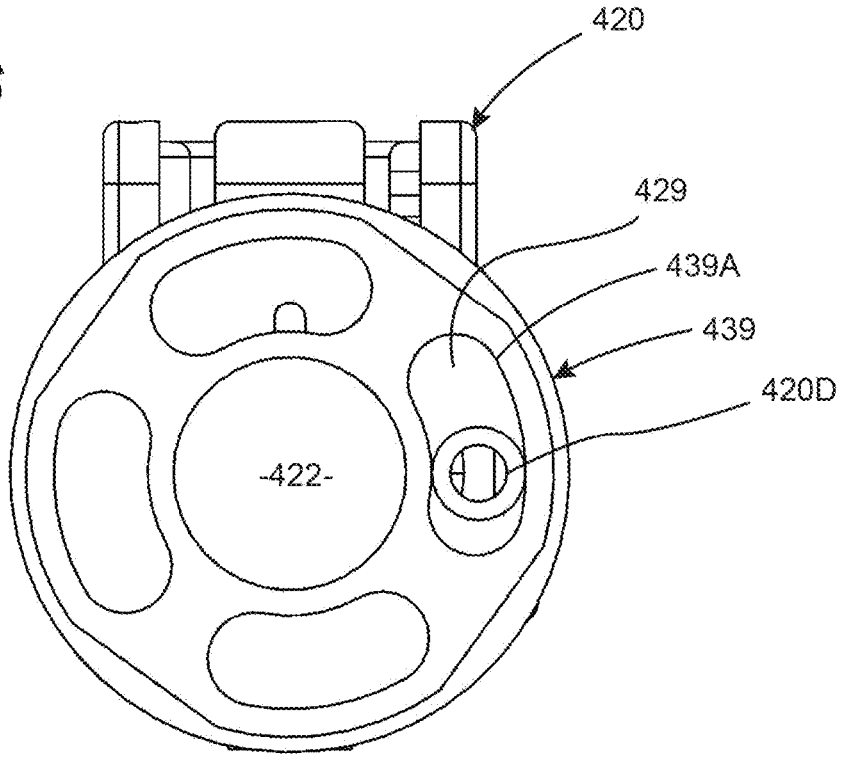
FIG. 16 is a front view of a receiver system of a firearm in accordance with a fourth embodiment of the disclosures made herein.
Figure 17:
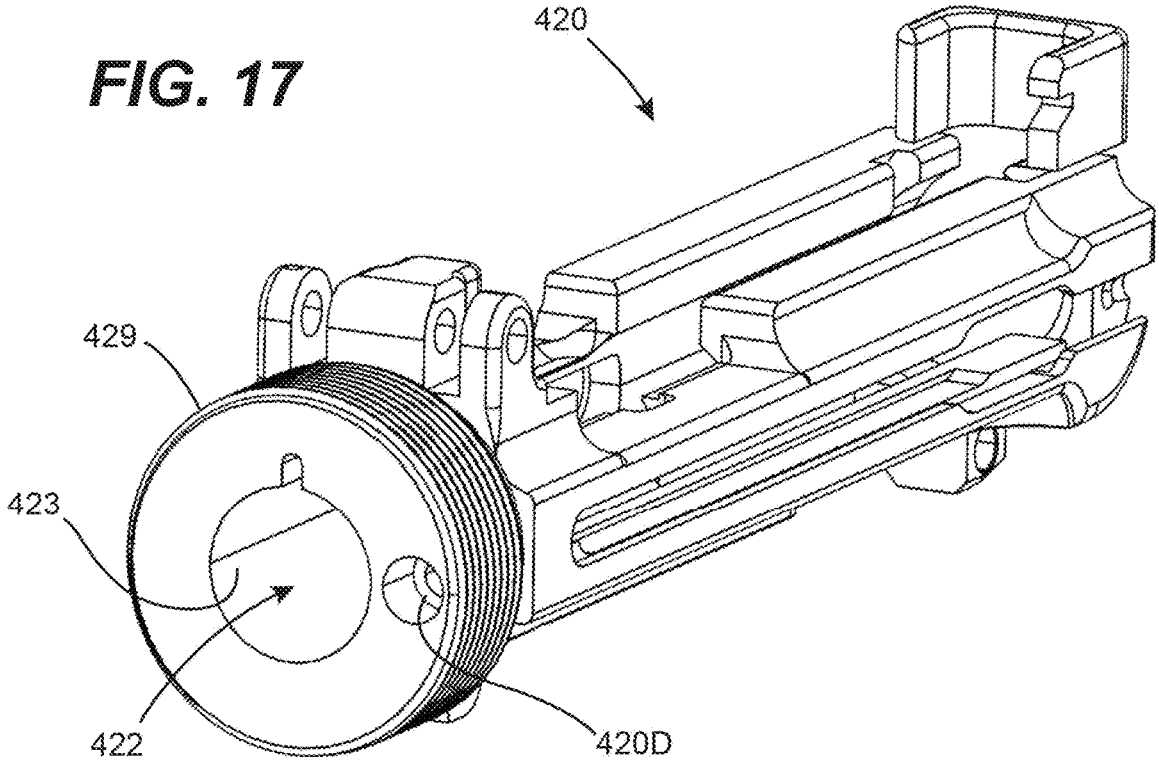
FIG. 17 is a perspective view of the receiver body shown in FIG. 16.

Referring to FIGS. 16 and 17, an upper receiver body 420 in accordance with a fourth embodiment of the disclosures made herein is shown. The upper receiver body 420 may be configured for being supplied belt-fed ammunition and/or magazine-fed ammunition. The upper receiver body 420 includes a central bore 422 configured for having a bolt carrier slidably disposed therein. The central bore 422 includes a barrel-receiving receptacle 423 that extends into a front mounting body 429 of the upper receiver body 420. An energy delivery member passage 420D extends through the front mounting body 429. A barrel extension fastener 439 is threadedly engaged with a threaded exterior surface of the front mounting body 429 for enabling a barrel extension to be fixedly secured within the barrel-receiving receptacle 423. The barrel extension fastener 439 may include one or more openings 439A within a front wall thereof. One or more of the openings 439A is positioned within the front wall of the barrel extension fastener 439 for enabling its alignment with energy delivery member passage 420D while the barrel extension fastener 439 is threadedly engaged with the front mounting body 429 with a barrel extension disposed within the barrel-receiving receptacle 423.

Figure 18:
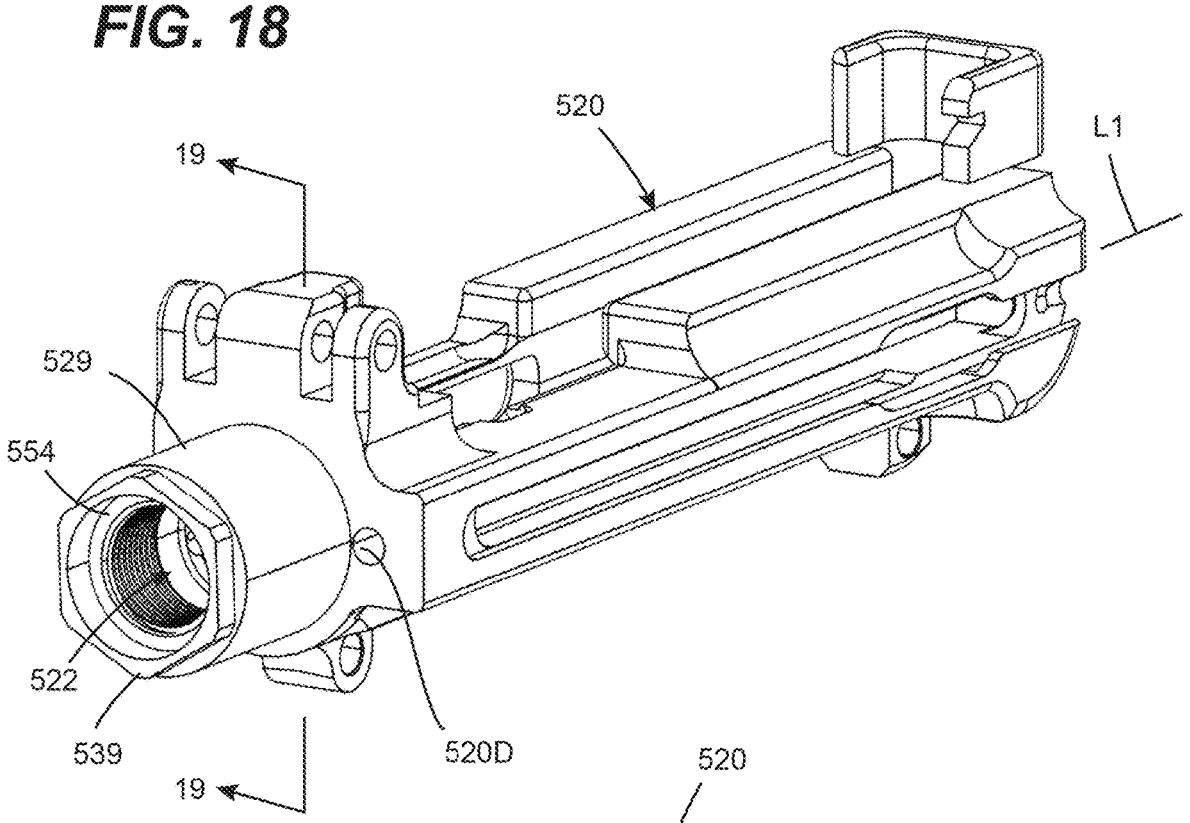
FIG. 18 is a perspective view of a receiver system of a firearm in accordance with a fifth embodiment of the disclosures made herein.
Figure 19:
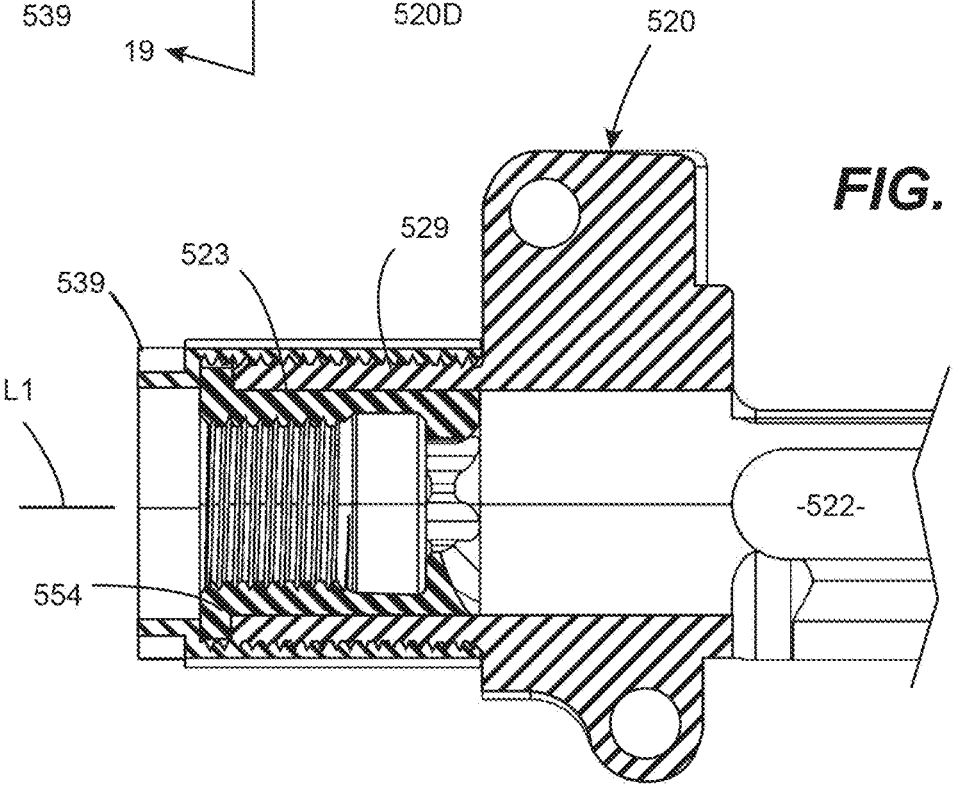
FIG. 19 is a fragmentary cross-sectional view taken along the line 19-19 in FIG. 18.

Referring to FIGS. 18 and 19, an upper receiver body 520 in accordance with a fifth embodiment of the disclosures made herein is shown. The upper receiver body 520 may be configured for being supplied belt-fed ammunition and/or magazine-fed ammunition. The upper receiver body 520 includes a central bore 522 configured for having a bolt carrier slidably disposed therein. The central bore 522 includes a barrel-receiving receptacle 523 that extends into a front mounting body 529 of the upper receiver body 520. An energy delivery member passage 520D extends through a front face of the upper receiver body 520 at a location laterally spaced away from the front mounting body 529. A barrel extension fastener 539 is threadedly engaged with a threaded exterior surface of the front mounting body 529 for enabling a barrel extension 554 to be fixedly secured within the barrel-receiving receptacle 523.

It is disclosed herein that firearms in accordance with different embodiments may have a common construction in regard to the central bore and associated bolt carrier group integration/operation. Additionally, upper receiver bodies in accordance with various embodiments of the disclosure made herein may have an identical construction with respect to the receiver portion of a respective upper receiver body (e.g., portion of the upper receiver body rearward of the front mounting lug). For example, the structural configuration rearward of the front mounting lug may be identical for embodiments of upper receiver bodies having different barrel-receiving receptacle configurations, front mounting body configurations, pressure relief functionality configuration, and combinations thereof. Conversely, receiver bodies in accordance with various embodiments of the disclosure made herein may have different construction with respect to the receiver portion of a different one of the receiver bodies—e.g., magazine-feed only vs. dual-feed, different underlying firearm configuration (e.g., rifle vs. pistol), different bolt carrier group engagement/operability, different trigger group attachment configuration, etc.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm receiver system, comprising:

a receiver including a handguard mounting body defining a front end portion of the receiver and a central bore configured for having a bolt carrier slidably disposed therein, and wherein the central bore includes a barrel-receiving receptacle at least partially located within the handguard mounting body; and a handguard including a handguard mounting body receptacle at a first end portion thereof, wherein the handguard mounting body receptacle includes a plurality of interior surfaces each matingly engaged with a corresponding one of a plurality of exterior surfaces of the handguard mounting body, wherein one of said interior surfaces of the handguard mounting body receptacle is a bolt energizing device engaging surface thereof, and wherein one of said exterior surfaces of the handguard mounting body is at least partially defined by a bolt energizing device engaging portion of the receiver.

2. The firearm receiver system of claim 1, wherein the handguard mounting body receptacle includes opposing handguard mounting body clamping members.

3. The firearm receiver system of claim 1, further comprising:

a bolt energizing device, wherein the handguard mounting body and the handguard jointly define a bolt energizing device receptacle for accommodating the bolt energizing device in a fixed orientation relative to the receiver.

4. The firearm receiver system of claim 3, wherein the handguard mounting body receptacle includes opposing handguard mounting body clamping members.

5. The firearm receiver system of claim 3, wherein:

one of said interior surfaces of the handguard mounting body receptacle is a bolt energizing device engaging surface thereof; and one of said exterior surfaces of the handguard mounting body is at least partially defined by a bolt energizing device engaging portion of the receiver.

6. The firearm receiver system of claim 3, wherein:

the bolt energizing device includes an operating rod that passes through an operating rod passage of the handguard mounting body;

the operating rod passage extends parallel to a centerline longitudinal axis of the central bore;

the operating rod passage is located at one of opposing sides of the receiver; and a top side and a bottom side of the receiver are located between said opposing sides.

7. A firearm receiver system, comprising:

a receiver including a handguard mounting body defining a front end portion of the receiver and a central bore configured for having a bolt carrier slidably disposed therein, and wherein the central bore includes a barrel-receiving receptacle at least partially located within the handguard mounting body;

a handguard including a handguard mounting body receptacle at a first end portion thereof, wherein the handguard mounting body receptacle includes a plurality of interior surfaces each matingly engaged with a corresponding one of a plurality of exterior surfaces of the handguard mounting body; and a bolt energizing device, wherein the handguard mounting body and the handguard jointly define a bolt energizing device receptacle for accommodating the bolt energizing device in a fixed orientation relative to the receiver;

wherein one of said interior surfaces of the handguard mounting body receptacle is a bolt energizing device engaging surface thereof;

wherein one of said exterior surfaces of the handguard mounting body is at least partially defined by a bolt energizing device engaging portion of the receiver;

wherein the bolt energizing device includes an operating rod that passes through an operating rod passage of the handguard mounting body;

wherein the operating rod passage extends parallel to a centerline longitudinal axis of the central bore;

wherein the operating rod passage is located at one of opposing sides of the receiver; and wherein a top side and a bottom side of the receiver are located between said opposing sides.

8. The firearm receiver system of claim 7, wherein the operating rod passage terminates into a space having a bolt carrier energy impingement member channel extending along a first side and a charging handle channel extending along a second side.

9. A firearm receiver system, comprising:

a receiver including a handguard mounting body defining a front end portion of the receiver and a central bore configured for having a bolt carrier slidably disposed therein, and wherein the central bore includes a barrel-receiving receptacle at least partially located within the handguard mounting body;

a handguard including a handguard mounting body receptacle at a first end portion thereof, wherein the handguard mounting body receptacle includes a plurality of interior surfaces each matingly engaged with a corresponding one of a plurality of exterior surfaces of the handguard mounting body; and an ammunition belt feed assembly integral with the receiver;

wherein one of said interior surfaces of the handguard mounting body receptacle is a bolt energizing device engaging surface thereof; and wherein one of said exterior surfaces of the handguard mounting body is at least partially defined by a bolt energizing device engaging portion of the receiver.

10. The firearm receiver system of claim 9, further comprising:

a barrel extension engaged within the barrel-receiving receptacle, wherein at least a portion of an interior surface of the barrel-receiving receptacle is threaded; and a barrel extension fastener threadedly engaged with the threaded interior surface of the barrel-receiving receptacle for securing the barrel extension in a fixed position relative to the receiver.

11. The firearm receiver system of claim 1, further comprising:

a barrel extension engaged within the barrel-receiving receptacle, wherein at least a portion of an interior surface of the barrel-receiving receptacle is threaded; and a barrel extension fastener threadedly engaged with the threaded interior surface of the barrel-receiving receptacle for securing the barrel extension in a fixed position relative to the receiver.

12. The firearm receiver system of claim 1, wherein the bolt energizing device includes an operating rod that passes through an operating rod passage of the handguard mounting body.

13. The firearm receiver system of claim 12, further comprising:

a bolt energizing device, wherein the handguard mounting body and the handguard jointly define a bolt energizing device receptacle for accommodating the bolt energizing device in a fixed orientation relative to the receiver.

14. The firearm receiver system of claim 13, wherein at least one of:

one of said interior surfaces of the handguard mounting body receptacle is a bolt energizing device engaging surface thereof; and one of said exterior surfaces of the handguard mounting body is at least partially defined by a bolt energizing device engaging portion of the receiver.

15. The firearm receiver system of claim 1, wherein at least one of:

one of said interior surfaces of the handguard mounting body receptacle is a bolt energizing device engaging surface thereof; and one of said exterior surfaces of the handguard mounting body is at least partially defined by a bolt energizing device engaging portion of the receiver.

16. The firearm receiver system of claim 5, wherein:

the bolt energizing device includes an operating rod that passes through an operating rod passage of the handguard mounting body;

the operating rod passage extends parallel to a centerline longitudinal axis of the central bore;

the operating rod passage is located at one of opposing sides of the receiver; and a top side and a bottom side of the receiver are located between said opposing sides.

17. The firearm receiver system of claim 9, further comprising:

a barrel extension engaged within the barrel-receiving receptacle, wherein at least a portion of an interior surface of the barrel-receiving receptacle is threaded.

18. The firearm receiver system of claim 9, further comprising:

a bolt energizing device, wherein the handguard mounting body and the handguard jointly define a bolt energizing device receptacle for accommodating the bolt energizing device in a fixed orientation relative to the receiver.

19. The firearm receiver system of claim 18, wherein:

one of said interior surfaces of the handguard mounting body receptacle is a bolt energizing device engaging surface thereof; and one of said exterior surfaces of the handguard mounting body is at least partially defined by a bolt energizing device engaging portion of the receiver.

20. The firearm receiver system of claim 19, wherein:

the bolt energizing device includes an operating rod that passes through an operating rod passage of the handguard mounting body;

the operating rod passage extends parallel to a centerline longitudinal axis of the central bore;

the operating rod passage is located at one of opposing sides of the receiver; and a top side and a bottom side of the receiver are located between said opposing sides.

21. The firearm receiver system of claim 18, wherein:

the bolt energizing device includes an operating rod that passes through an operating rod passage of the handguard mounting body;

the operating rod passage extends parallel to a centerline longitudinal axis of the central bore;

the operating rod passage is located at one of opposing sides of the receiver; and a top side and a bottom side of the receiver are located between said opposing sides.

* * * * *